United States Patent [19]

Nielsen

[11] 4,215,805

[45] Aug. 5, 1980

[54] PROPELLING HEAD FOR THE PNEUMATIC PROPELLING OF A MULTIFILAMENT TOW

[75] Inventor: Ejvind R. Nielsen, Nr. Åby, Denmark

[73] Assignee: N.F. Udviklingscenter A/S, Copenhagen, Denmark

[21] Appl. No.: 953,108

[22] Filed: Oct. 20, 1978

[30] Foreign Application Priority Data

Sep. 18, 1978 [DK] Denmark ..... 4126/78

[51] Int. Cl.[2] ..... B65H 51/16

[52] U.S. Cl. ..... 226/97; 28/254

[58] Field of Search ..... 226/97, 7; 28/254; 68/5 E

[56] References Cited

U.S. PATENT DOCUMENTS

| | | | |
|---|---|---|---|
| 2,302,790 | 11/1942 | Modigliani | 226/97 |
| 2,971,243 | 2/1961 | Burns | 226/7 |
| 3,424,359 | 1/1969 | Hoole et al. | 226/97 |
| 3,580,445 | 5/1971 | Moore, Jr. | 226/97 |

FOREIGN PATENT DOCUMENTS

| | | | |
|---|---|---|---|
| 619515 | 5/1961 | Canada | 226/97 |

*Primary Examiner*—George F. Mautz

*Attorney, Agent, or Firm*—Watson, Cole, Grindle & Watson

[57] ABSTRACT

A propelling head for the pneumatic propelling of a multifilament tow, e.g., for use in the filling of textile or network bags, hoses, sacks, or bed cover channels for padding or insulating purposes, has a rear end through which the tow enters and a front end through which the tow is propelled by means of air injected into the head in such a manner as to produce a flow of air directed towards and out of the front end. Behind the zone of injection of air the head is closed with the exception of a tow engaging hole which fits closely around the tow entering the head to prevent or reduce the escape of air through the rear end of the head.

6 Claims, 12 Drawing Figures

PROPELLING HEAD FOR THE PNEUMATIC PROPELLING OF A MULTIFILAMENT TOW

BACKGROUND OF THE INVENTION

The invention relates to a propelling head for the pneumatic propelling of a multifilament tow, preferably consisting of endless fibres, the head comprising a housing constructed with a venturi portion and having a rear tow entrance end, a front tow exit end, at least one intermediate compressed air inlet conduit, and a centrally arranged through passage for the tow, the through passage extending centrally from the rear end to the front end, the air being conducted from the compressed air inlet conduit into the through passage.

In a known propelling head of this kind the compressed air is conducted from the inlet port to a tube provided at the tow exit end along the inner peripheral wall of the through passage, the tube being provided with a number of air outlet holes directed towards the tow exit end, the air jets or flows thereby produced propelling the multifilament tow by exerting thereon a propelling force in the direction towards the tow exit end, where the venturi portion of the housing serves to guide the flow of air towards the surface of the tow present in the through passage.

SUMMARY OF THE INVENTION

According to the invention, a propelling head for the pneumatic propelling of a multifilament tow comprises a rear tow entrance end and a front tow exit end, air injection means for creating a tow propelling flow of air within the head out of the front end, and means for closing the housing behind the air injection means with the exception of a tow engaging hole fitting closely around the multifilament tow to be propelled. By this arrangement an improved efficiency of the air used for the propelling is obtained, because the air can now practically only leave the front end of the head together with the tow being propelled, while in the known head referred to above a substantial proportion of the air employed may leave the head at its tow entrance end. Thus, with the same amount of air consumption and the same dimensions of the head, a higher air velocity can be obtained at the front end of the propelling head, whereby the propelling force acting on the multifilament tow is increased. It has been found that the propelling force may be still further increased by arranging the tow engaging hole eccentrically with respect to the path along which the tow is being propelled by the injected air adjacent the exit end of the head.

In a practical way of carrying out this general concept, a propelling head for the pneumatic propelling of a multifilament two, preferably consisting of endless fibres, comprises a housing constructed with a venturi portion and having a rear tow entrance end, a front tow exit end, at least one intermediate compressed air inlet conduit, and a centrally arranged through passage for the tow, the through passage extending centrally from the rear end to the front end, the air being conducted from the compressed air inlet conduit into the through passage, the rearmost part of the through passage being constituted by a first tubular member which has a closing member with a tow engaging hole for producing a closure between the tow supplied to the head and the inner wall of the first tubular member, the first tubular member being sealingly mounted in the housing adjacent its rear end.

In a preferred embodiment of the invention, the through passage for the tow is delimited, as counted from the rear end to the front end of the housing, by the first tubular member, which has a decreasing or substantially constant inner cross-section, an annular slot for the introduction of the air from the inlet conduit, and a second tubular member having an increasing or substantially constant inner cross-section, the closing member of the first tubular member being formed by constructing the first tubular member in part of or the whole of its length with a minimum cross-section or tow engaging hole so adjusted to the cross-section of the tow as to fit closely around the tow to constrain the escape of air from the annular slot through the tow entrance end of the housing, an annular chamber being formed around the first tubular member between the compressed air inlet port and the annular slot, the annular chamber being delimited by the outer wall of the first tubular member, the inner wall of the housing including its venturi portion, the supply opening of the compressed air inlet conduit, and the annular slot, the annular chamber opening into the through passage for the tow in the zone of the venturi portion of the housing. This arrangement makes the propelling head suitable for operation by blower air, i.e., low pressure air, instead of pressure air at 3—12 bar, which has been commonly used in conventional tow propelling heads.

Advantageously, the annular slot is so constructed that in cooperation with the second tubular member or with the venturi portion of the housing it conducts the air into the through passage parallel to or under an acute angle with the axis of the through passage and in a direction towards the tow exit end and away from the closing member. Hereby a higher propelling force is obtained than if the annular slot would direct the air perpendicularly into the through passage.

Preferably, the first tubular member with the closing member is longitudinally displaceably mounted in the housing. By this arrangement it becomes possible to adjust the inclination of the current of air flowing through the angular slot to the axis of the through passage in accordance with the type of tow to be propelled so as to achieve an optimum of the propelling force, and likewise it will be possible to cut off the air wholly or partly in order to determine the speed of propelling of the tow.

In order to avoid undesirable twisting of the tow during the propelling the first tubular member may be provided exteriorly with longitudinal guiding ribs for the air entering the through passage. The effect of this arrangement is that even if the supply air has a rotating component of movement this will be converted into a component directed longitudinally of the through passage so as to improve the propelling of the tow.

By making the first tubular member angularly adjustable relative to the housing about the axis of the propelling head, the location of the guiding ribs on the first tubular member can be adjusted to the state of flow through the housing, which may be influenced by minor inaccuracies of the walls of the tubular chamber, so as to parallelize any rotating currents of air with the axis of the housing. If the first tubular member is constructed with an outer thread engaging with an inner thread at the rear end of the housing, adjustment of the first tubular member both longitudinally and angularly can be obtained simultaneously.

In an advantageous arrangement, the annular chamber is connected with a plurality of air inlet conduits, the axes of which intersect the axis of the through passage in the same point under the same acute angle $\gamma$, the supply openings of the conduits being located at the same distance from the axis of the through passage and at the same distance from the annular slot. By this arrangement, even greater quantities of air may be supplied to the propelling head per time unit, and the uniformly distributed arrangement of the air inlet conduits will at the same time reduce the tendency of the air to rotate about the axis of the housing.

A still more efficient guiding of the air to suppress rotation of the air and thereby to obtain a still higher propelling force may be obtained by providing the annular chamber with guiding ribs constructed to divert air from the zone of transition between the compressed air inlet conduit and the annular chamber to the annular slot from a direction of flow which is determined by the axial direction of the compressed air inlet conduit in the area of transition to a direction of flow parallel to the axis of the through passage, the guiding ribs being spaced from the first annular member.

Advantageously, the tow engaging hole of the closing member has a cross-sectional area corresponding to the cross-sectional area of the tow to be propelled in slightly gathered condition, and more particularly the cross-sectional area of the tow engaging hole is between $N \times 0.17$ cm$^2$ and $N \times 0.44$ cm$^2$, where N is the kTex-value of the multifilament tow. By constructing the closing member with a tow engaging hole, the cross-sectional area of which is adjustable, the same tow engaging hole may be used for different types of tows.

In further development of this concept, the tow engaging hole may be lined with an elastically yielding, interiorly smooth sleeve, one end of which is fixed to the edge of the hole, the other end of the sleeve extending freely from the end of the hole facing the annular slot. When a pressure is built up in the housing, this will then tend to press the resilient sleeve against the tow so as to improve the fitting of the sleeve around the hole.

In order to avoid excessive constriction of the sleeve, the said other end of the sleeve may be provided with a reinforcement for limiting the decrease of cross-sectional area of the sleeve.

Advantageously, the second tubular member at the front end of the through passage for the tow may be constituted by an elongated extension tube of substantially constant inner cross-sectional area and extending from the housing in a length which is at least four times the minimum diameter of the venturi portion of the housing. By this arrangement the advantage is obtained that the propelling head may at the same time be used for the spreading of a non-twisted multifilament tow. It has been found that such a spreading takes place in the extension tube at a certain distance from the annular slot, probably owing to the tendency of the air to be set in waving movement in a tube of a certain length. This effect may be utilized for simultaneously propelling and spreading the tow so as to make it more bulky, e.g., with a view to the filling of channel bed covers, pillows and other hollow articles with multifilament tow material, e.g., for padding or heat insulating purposes.

In this application of the invention, the extension tube may advantageously be constructed at its end remote from the closing member with a flange extending radially outwards and having a circumferential contour corresponding to that of a filling opening of the article to be filled, the flange being constructed with through holes, and with a conical net which at its maximum diameter is fixed to the circumference of the flange and its minimum diameter is fixed to the tube between the flange and the free end of the tube. This arrangement is suitable for use when the cavities, into which spread-out bulky multifilament tow material is to be introduced, are so impervious that the excape of the propelling air from the bulky tow material may result in waste of tow material, which is carried along by the escaping air. The noted flange keeps the material delivery tube at a distance from the wall of the cavity or the edge of the filling opening, and the net and the holes of the flange permit the passage of the escaping air, while the net retains the tow material in the cavity.

BRIEF-DESCRIPTION OF THE DRAWINGS

DESCRIPTION OF THE PREFERRED EMBODIMENTS

Figure 1:
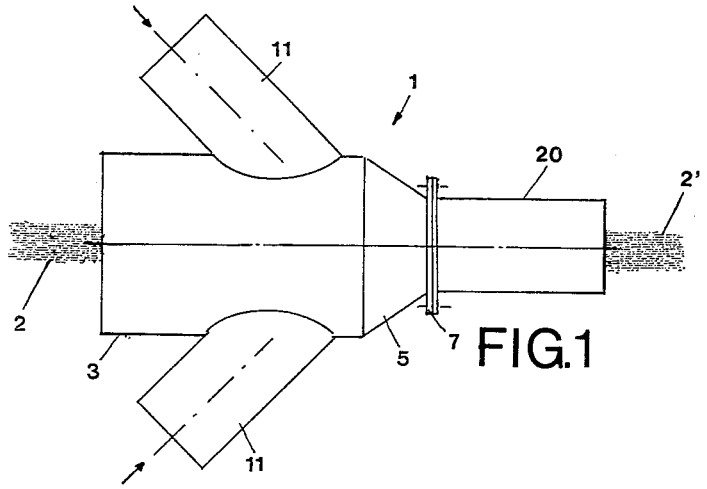
FIG. 1 shows a propelling head according to one embodiment of the invention, as seen from one side, in the process of propelling a multifilament tow by means of blower air.

FIG. 1 shows a propelling head for the pneumatic propelling of a multifilament tow, preferably consisting of endless fibres, at any rate if the multifilament tow is non-twisted. The tow may e.g., consist of crimped nylon, polyester, polypropylene or viscose-rayon yarns. The propelling head comprises a housing 1 constructed with a venturi portion 5 and having a rear tow entrance end 3 for a tow 2, a front tow exit end 20, from which the propelled tow 2' emerges, and an air inlet conduit 11 either for pressurized air or for blower air connected to the housing 1 between its ends. In the embodiment illustrated in FIG. 1 the tow exit end 20 is constituted by a feeding tube fixed to a flange 7 of the head, in the following referred to as "the second tubular member".

Figure 2:
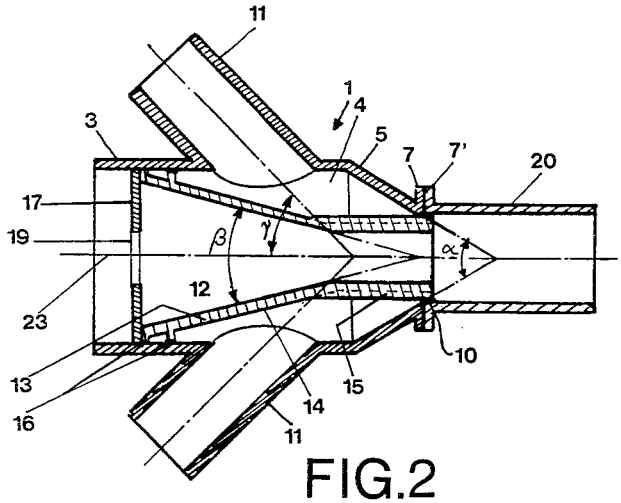
FIG. 2 is a longitudinal section through the embodiment of FIG. 1 with the first tubular member of the propelling head in its advanced position and with the tow engaging hole located coaxially with the longitudinal axis of the propelling head.
Figure 5:
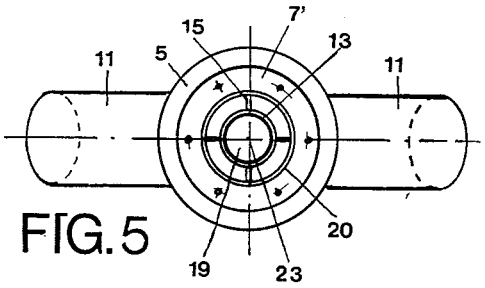
FIG. 5 shows the propelling head of FIG. 2 as viewed from the right.

FIG. 2 shows a longitudinal section through the propelling head of FIG. 1, which has a centrally located through passage 12 for the tow extending axially through the housing from its rear end to its front end. The air arriving from the air inlet conduit 11 is guided into this through passage 12. The rear portion of the through passage 12 for the tow is delimited by a first tubular member 13, which has a closing member constituted in the embodiment shown by a plate 17 sealingly arranged in the housing 1 at its rear end 3 and having a concentrically located hole 19 so that a closure is formed between the tow 2 being propelled and the inner wall of the first tubular member 13. The first tubular member is sealingly mounted in the housing at the rear end 3 thereof via a pair of supporting and centering flanges 16, which permit the first tubular member 13 to be displaced in the longitudinal direction of the housing with maintenance of the sealing fit between the housing and the tubular member, and of the centering of the tubular member in the housing. In the embodiment shown, the head is symmetrical about an axis 23, which also constitutes the axis of the first tubular member 13 and of the second tubular member 20. The compressed air inlet ports 11 intersect the axis of the head under an angle $\gamma$, and the inner face of the conical housing portion 5 has its apex in the axis 23 and forms a cone angle $\alpha$. The first tubular member 13 is in this case constructed with a conical tube portion 14, the inner face of which forms a cone angle $\beta$, and with a cylindrical portion which is exteriorly provided with guiding ribs 15 which, as illustrated in FIG. 5, may be symmetrically arranged with respect to the axis of the compressed air inlet conduit 11.

Figure 4:
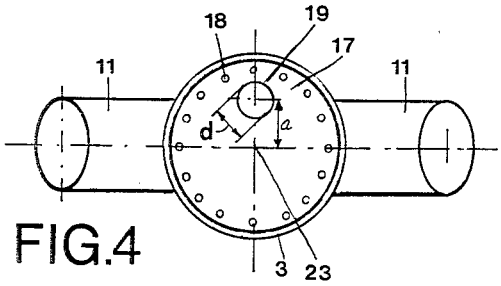
FIG. 4 shows the propelling head of FIG. 2 as viewed from the left, but with the tow engaging hole located eccentrically.

The through passage 12 for the tow, as counted from the rear end 3 to the front end 20 of the housing 1, is delimited by the tow engaging hole 19, the first tubular member 13, which has a decreasing inner cross-section, an annular slot 10 for the introduction of the air from the conduit 11 into the through passage 12, and a second tubular member 20, which has a constant inner cross-section. The diameter of the tow engaging hole 19 in FIGS. 2 and 4 is adjusted to the cross-sectional area of the tow in such a manner that the hole fits relatively closely around the tow to constrain the escape of air from the annular slot 10 through the tow entrance end 3 of the housing. An annular chamber 4 is formed in the housing 1 around the first tubular member 13 between the compressed air inlet port 11 and the annular slot 10. The annular chamber 4 is delimited by the outer wall of the first tubular member 13, the inner wall of the housing 1 including the venturi portion 5, the supply opening of the compressed air inlet conduit 11, and the annular slot 10, the annular chamber 4 opening into the through passage 12 for the tow 2 in the zone of the venturi portion 5 of the housing 1. As illustrated in FIG. 4, the tow-engaging plate 17 is attached to the outer flange 16 of the first tubular member 13 by fastening means, such as screws 18. In FIG. 4 the tow-engaging hole 19 is located at a distance a from the axis 23 of the propelling head. The second tubular member 20, which is located at the front end of the head, is attached by means of its flange 7' to the flange 7 of the conical housing portion 5, but the tubular member 15 could of course be constructed integrally with the conical housing portion 5. The annular slot 10 is constructed to co-operate with the second tubular member 20 or with the venturi portion 5 of the housing 1 to guide the air into the through passage 12 parallel to or at an acute angle with the axis 23 and away from the closing plate 17.

As mentioned, the first tubular member 13 with the closing plate 17 is longitudinally displaceably mounted in the housing 1. Thereby the air may be guided into the through passage 12 practically parallel to the axis, when the tubular member is in its advanced position, or under an acute angle with the axis 23, when the tubular member 13 is in its retracted position. The guiding ribs 15 ensure that any rotating components of movement of the air about the axis of the head are suppressed so that the air flow cannot exert any twisting effect on the tow being propelled. If it is found in practice that some twisting effect is still exerted on the tow, the position of the guiding ribs 15 in the housing 1 may be changed by turning the tubular member 13 about the axis 23 of the head until the rotating component disappears or is reduced to a minimum value. Instead of two compressed air inlet conduits 11, a greater number of such conduits may be provided, which should then be uniformly distributed about the axis 23 of the head.

Figure 3:
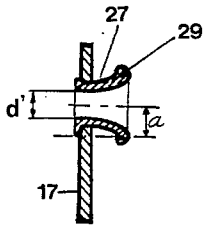
FIG. 3 shows one form of the closing member of the first tubular member, where this is provided with an automatically adjustable, eccentrically located tow engaging hole.

FIG. 3 shows a form of the closing member, in which the hole 19 of the closing plate is lined with an elastically yieldable sleeve 27, which may be provided with a reinforcing ring 29 to prevent the sleeve 27 from contracting excessively when, during the operation of the propelling head, a certain pressure is built up at the front side of the plate 17. This pressure will press the sleeve 27 against the tow to reduce the escape of air through the rear end of the housing to a minimum. The inner diameter d' of the sleeve 27 will thus adapt itself to the thickness of the tow as compressed. The tow-engaging hole may also be varied in other ways, e.g., by replacing the closing plate 17 by another one or by constructing the hole in the form of an adjustable shutter, e.g. of the type used in cameras. To achieve a satisfactory propelling force the tow engaging-hole should have a cross-sectional area corresponding to the cross-sectional area of the tow in a slightly opened state. Experiments have shown that this cross-sectional area may advantageously be in the range between $N \times 0.17$ $cm^2$ and $N \times 0.44$ $cm^2$, where N is the kTex-value of the multifilament tow indicating the weight in kg of 1000 m of the multifilament tow. The hole 19 may be arranged coaxially with the axis of the head as illustrated in FIG. 2, but it has been found by experiment that an increase of the propelling force is obtained when the hole is eccentrically located as illustrated in FIG. 3 and 4.

Figure 6:
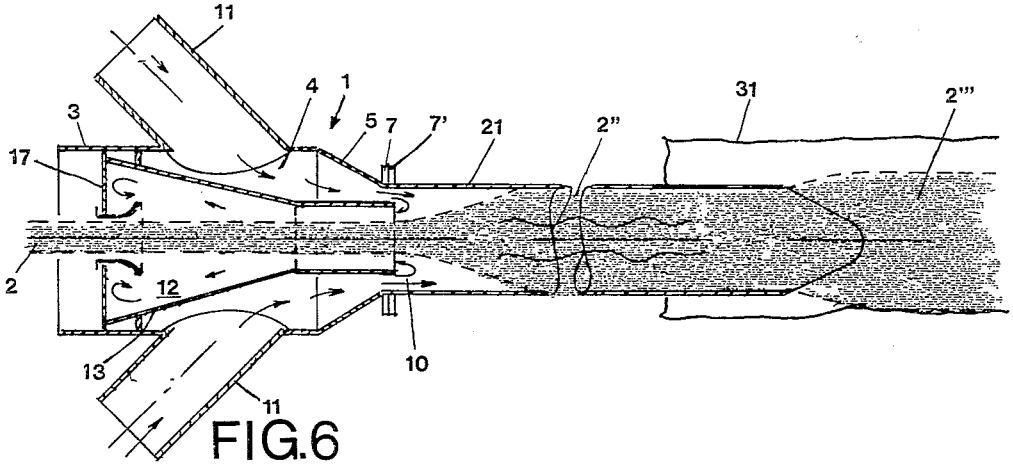
FIG. 6 is a longitudinal section of a propelling head similar to that of FIG. 2, but where the second tubular member has been replaced by an elongated extension tube for the filling of a channel of a bed cover.

In FIG. 6 an extension tube or filling tube 21 is connected to the propelling head instead of the substantially shorter tubular element 20. The air for the propelling of the multifilament tow flows as indicated by the arrows, and owing to the use of the extension tube 21 a change of the configuration of the tow 2 takes place in that tube after the exit of the tow from the propelling head, the tow being set in a sort of waving movement by the air in the extension tube 21 at a certain distance from the propelling head, whereby the tow is spread and made more bulky when it leaves the extension tube 21, the end of which is nibbed, to facilitate the introduction of the tube into such a channel of a bed cover 31. The tube is first forwarded to the far end of the channel, whereafter blower air is supplied to the air inlet conduits 11 to start up the propelling head which feeds material to the extension tube 21, from which the material is delivered in the channel, in which the material 2''' is somewhat compressed by the still remaining propelling force of the air, while at the same time the extension tube 21 is retracted, as the filling of the channel in the bed cover 31 proceeds. When the channel has been filled, the supply of air is stopped, or the tow 2 is braked up-stream of the propelling head, and the fibre material is cut off at the end of the extension tube 21.

Figure 7:
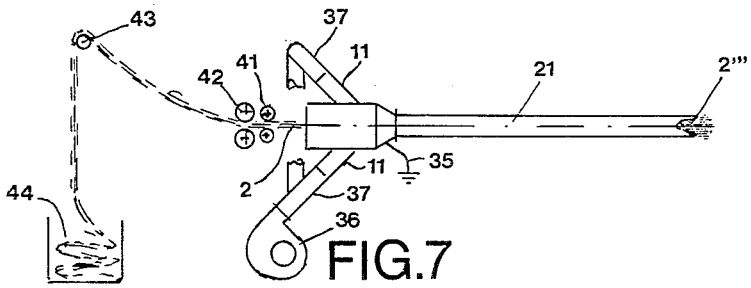
FIG. 7 is a side view of the modified propelling head of FIG. 6 as built into a feeding apparatus with multifilament tow supply and blower air supply.

FIG. 7 shows an arrangement of a propelling head with extension tube 21, where the air is supplied to the inlet conduits 11 by a blower 36, from which blower air is conducted to the head via blower air hoses 37. Upstream of the head the tow 2 is engaged by two pairs of stretching and/or stopping rollers 41 and 42. Where these are used as pairs of stretching rollers they are driven at different speeds, the pair of rollers 41 being driven at a higher speed, e.g. 40% higher than that of the pair of rollers 42. When the propelling of the tow is to be stopped, the two pairs of rollers 41 and 42 are stopped, and in operation the two pairs of rollers serve for opening the tow. The tow is drawn off from a tow supply viz. a bale 44, via a guiding roller or guiding rod 43, from which it proceeds to the pair of rollers 42. Since in operation substantial electrostatic charges of the apparatus may occur, the propelling head may advantageously be earthed either via a separate earth lead 35 or through an earthed frame of the apparatus. When the bulky multifilament tow material leaves the extension tube 21 and proceeds to a cvaity having a lower pressure than that prevailing in the extension tube, the bulkiness of the material is increased, provided that the air present in the material is permitted to escape, which is e.g., the case if the channel wall 31 is constituted by textile or network bags, hoses, sacks or bed cover channels, which may be open at both channel ends, if the material is relatively impervious, but need not be open at both ends, if the material is relatively pervious.

Figure 8:
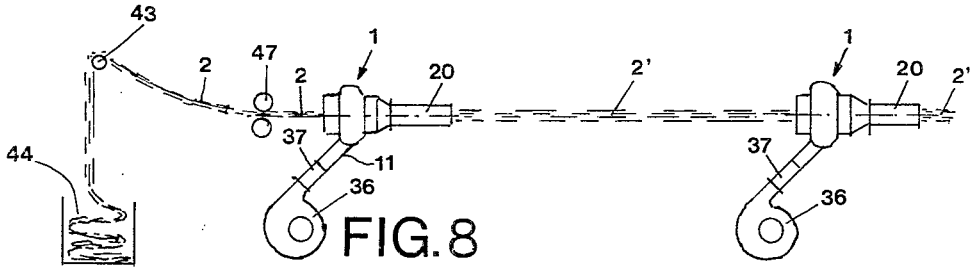
FIG. 8 shows a plurality of propelling heads of an apparatus for the long distance conveying of a multifilament tow.

FIG. 8 shows an apparatus for conveying a multifilament tow from a bale 44 to a place of use at a greater distance from the bale 44. In this case a single or a plurality of propelling heads according to the invention may be used, the propelling heads being constructed with individual air supply systems or a common air supply system. The tow 2 is fed from the bale 44 via the guiding rod 43 and a pair of stopping rollers 47 to the successive propelling heads, in which no spreading of the multifilament tow need take place.

Figure 9:
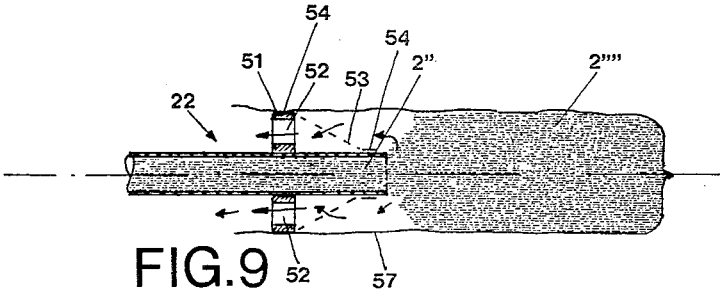
FIG. 9 shows an arrangement for the separation of fibre filling and air at the end of the extension tube.

The multifilament tow being propelled may also consist of twisted yarns for yarn consuming machines. FIG. 9 shows the end configuration 22 of the extension tube 21 in the case where the propelling head is to be used in conjunction with a filling tube 21 for filling a relatively impervious channel, such as an impervious bed cover channel 57, which is closed at its end. To enable the air to escape from the filling without carrying along filling material 2'''', this filling material 2'''' being additional longitudinally compressed by the propelling force, the tube end 22 is provided with a radially extending flange 51 which serves as a distension flange or spacing flange for the cavity wall or bed cover channel 57, the flange being provided with through holes 52 for the escape of air. Between the circumference of the flange 51 and the outer end of the filling tube 21 a conical net 53 is arranged for retaining the fibres, which may be filament fibres with admixed natural fibres such as down and feathers. The net 53 is fixed to the tube end 22 and the flange 51 in areas 54 by adhesion, welding or other fastening methods. Thereby the air can escape from the fibre material first through the net and then through the air escape holes 52 to the open end of the cavity wall 57. The net is conically shaped in order to obtain a larger and easily cleanable filter surface, but also serves to facilitate the introduction of the tube end 22 into a channel.

Figure 10:
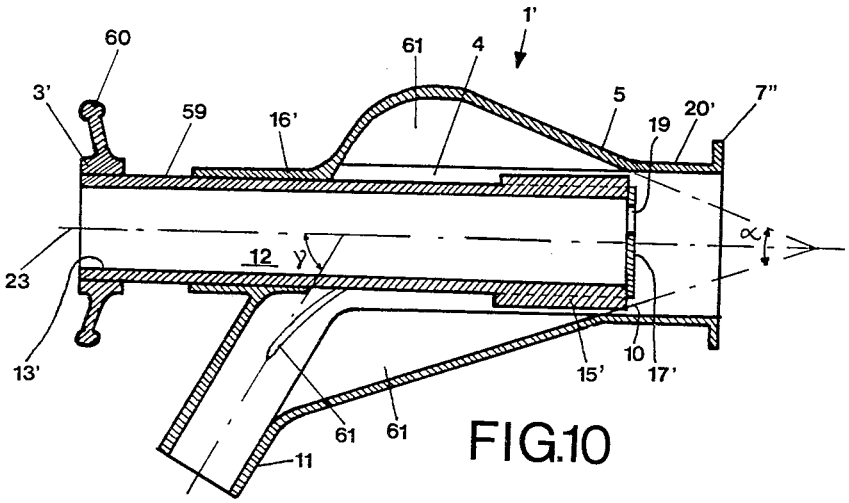
FIG. 10 shows another form of the propelling head with only a single air inlet port and with the tow-engaging member located adjacent the annular slot of the head.

FIG. 10 shows a substantially modified construction of the propelling head, in which the housing 1 is constructed in one piece with the second tubular member 20' and the mounting flange 7'' of the latter. Moreover, the housing 1' is provided with fixed interior guiding ribs 61 which change over the air flow from a direction parallel to the axis of the compressed air inlet conduit 11 to a direction parallel to the axis 23 of the propelling head. None of these guiding ribs are in contact with any part of the first tubular member 13', which has a practically constant inner cross-section, and at its front end is constructed with guiding ribs 15' and carries the tow engaging member 17' in the form of a circular plate having a tow engaging hole 19, and at its rear end 3' carries an adjusting handle 60, by means of which the first tubular member 13' may be longitudinally displaced along the axis 23 of the head and, if desired, angularly adjusted about that axis 23 by means of an inner thread or a sliding guide in a collar 16' on the rear end of the housing 1' engaging with an outer thread or sliding guide 59 on the first tubular member 13'.Also in this case the conical portion 5 of the housing forms a cone angle $\alpha$ with its apex located on the axis 23 of the head, and the air inlet conduit 11 forms an angle $\gamma$ preferably between 30° and 80° with the axis 23. This embodiment distinguishes itself by facilitating the adjustment of the propelling head according to the nature of the tow being propelled and the desired propelling speed, particularly if the closing plate 17 is either arranged at the rear end 3' or is provided with a self-adjusting closing sleeve 27 in the tow engaging hole 19.

Figure 11:
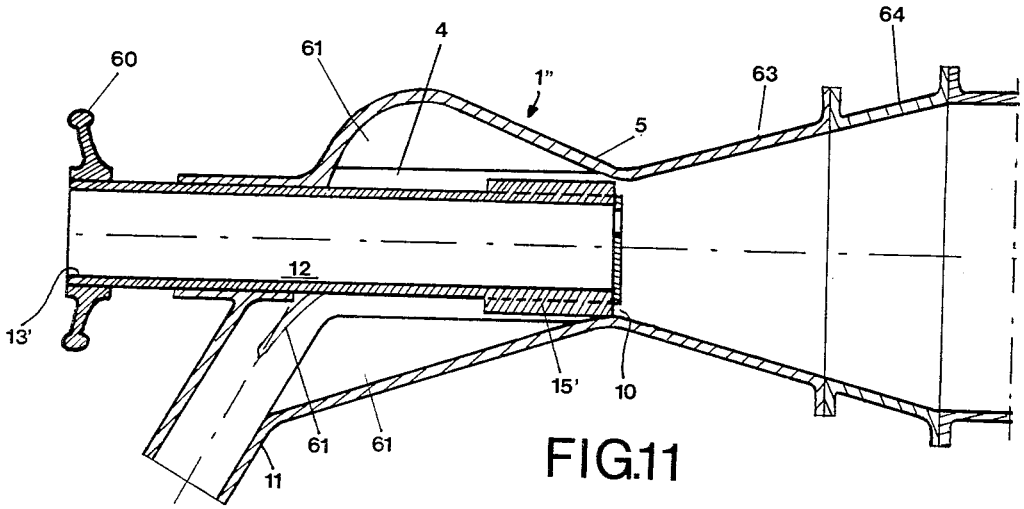
FIG. 11 shows a further form of the propelling head with a diffusor portion at the tow exit end.

Fig. 11 shows an embodiment in which the housing 1'' of the head, instead of the tubular member 20' having a constant inner section, is provided with a diffusor 63, whereby a smaller pressure drop and less whirling will occur at the annular slot 10, along with an increased air velocity and thereby an increased propelling capacity and an increased faculty of making the tow bulky and spread-out in the long extension tube 21, which may be connected via an adaptor element 64 which is likewise conical and thereby produces a smooth transition from the diffuser 63 to the extension tube 21.

Where the propelling head is used for the propelling of multifilament tow and for spreading it and making it more bulky in the extension tube 21 with a view to filling channels of bed covers, according to one example, a polyester tow of 39 KTex with individual filaments of 6.5 dTex and a crimping figure of 3.75, i.e. 3.75 crimps per cm, and a 39% crimping contraction may, be used. Such a tow may e.g., be propelled by means of a propelling head of the construction shown in FIG. 6 where the first tubular member has a length of 235 mm, an inner maximum diameter of 120 mm and an inner minimum diameter of 70 mm. The wall thickness may be 3 mm and the maximum distance of the guiding ribs from the axis of the tubular member may be 43 mm. The diameter of the closing plate may be 43 mm corresponding to the outer diameter of the supporting and centering flanges 16, the diameter of the tow engaging hole 19 may be 30 mm and the distance of the hole from the axis of the tubular member may be 15 mm. The length of the housing 1 from the rear end 3 to the mounting flange 7 may be 220 mm, the outer diameter of the flange 7 125 mm, the minimum inner diameter of the venturi portion 5 of the housing 86 mm and the cone angle $\alpha$ of the venturi portion 5 about 50°, the angle $\gamma$ of the air inlet conduit 11 with the axis 23 of the head being about 45°. The extension tube 21 employed in a test run had an inner diameter of 94 mm and a length of 2400 mm. The blower 36, Fig. 7, used in the test run had a power of 2 HP or 1472 Watt and delivered 700–1400 $Nm^3$ air per hour at a pressure of 9.8 Pa above the atmosphere. The diameter of the tow-engaging hole is adjusted in accordance with the kTex-value of the multifilament tow and the diameter 30 mm can be employed for tows with kTex-values in the range between 16 and 40 kTex. For finer tows, i.e. below 16 kTex, the diameter of the tow engaging hole should be less then 30 mm, and for values above 40 kTex the diameter of the tow engaging hole should be increased. For towns having a kTex-value of 39 a tow engaging hole of 38 mm diameter may also be used. The inner diameter 94 mm of the extension tube is suitable for fibre tows of 25–40 kTex, while an inner diameter of the extension tube of 75 mm is suitable for filament tows of 16–32 kTex. The length of the extension tube 21 depends on the available blower power. With the blower employed extension tubes having lengths in the range 1500–3000 mm could be used.

Figure 12:
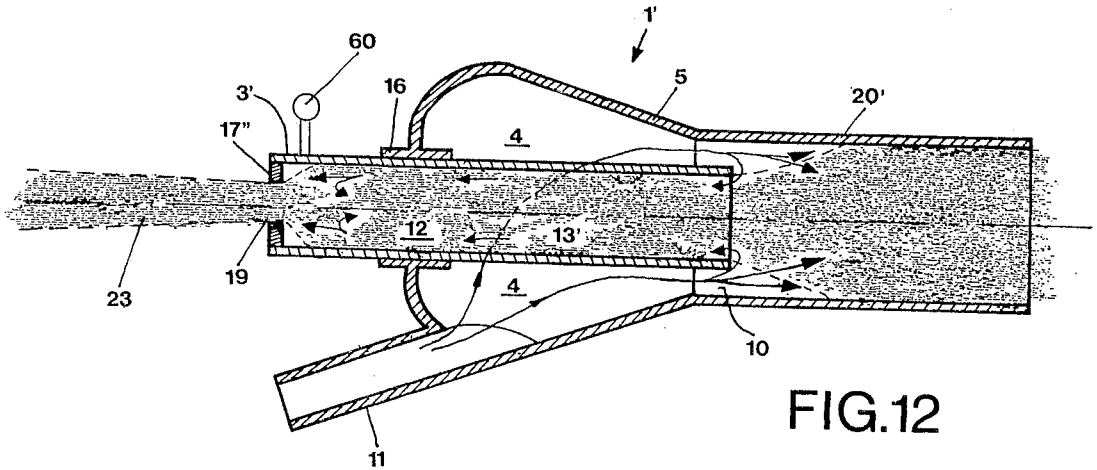
FIG. 12 shows a propelling head similar to that of FIG. 10, but in which the tow-engaging hole is located at the rear end and coaxially with the axis of the head.

FIG. 12 shows a propelling head built up similarly to that of FIG. 10, but with the tow engaging hole 19 arranged at the rear end 3' of the head and coaxially with the axis 23 of the head. Thereby the replacement of the closing plate is facilitated as compared with the propelling head of FIG. 10, and owing to the coaxial arrangement of the hole 19 this can be made larger than the eccentrically arranged hole in Fig. 10, whereby the propelling head can, with otherwise the same outer dimensions, be used for the propelling of thicker tows, seeing that the hole 19 can be given practically the same diameter as the inner diameter of the first tubular member 13'. By arranging the closing plate 17'' at the rear end the further advantage is obtained that in the first tubular member 3' the tow 2 is carried on an air cushion formed by the branched-off air current penetrating rearwards from the annular slot 10 into the tow.

As regards the inner diameter of the second tubular member 20, 20' and 21, it has been found advantageous to adjust the corresponding cross-sectional area in accordance with the kTex-value of the tow being propelled. This cross-sectional area may be in the range between $N \times 1.4$ $cm^2$ and $N \times 3.2$ $cm^2$, preferably $N \times 1.6$ $cm^2$, whereby both the propelling capacity of and the consumption of material for the second tubular member achieve optimum values.

The compressed air or blower air inlet conduit 11 may be arranged additionally to supply easily flowing particles, such as feathers, into the propelling head 1 when this is used for the filling of bed cover channels, whereby the particles are introduced into the bed cover together with the multifilament material.

I claim:

1. A propelling head for the pneumatic propelling of a multifilament tow, comprising a housing constructed with a venturi portion having a rear tow entrance end, a front tow exit end, a centrally arranged through passage for the tow, said through passage extending centrally from said rear tow entrance end to said front tow exit end, and annular chamber surrounding said through passage, said annular chamber having at least one compressed air inlet port, said annular chamber communicating with said through passage through an annular slot formed between the inner wall of said annular chamber and the outer wall of said through passage and forming said venturi portion, a member with a tow engaging hole being provided in the rear portion of said through passage to establish a closure between the tow entering the through passage and the inner wall of that passage, characterized in that the inner wall of said annular slot is substantially cylindrical, and longitudinal guiding ribs are provided in said annular slot for guiding the flow of air through said slot into said through passage.

2. A propelling head as in claim 1, in which said through passage is angularly adjustable relative to the housing about the axis of the propelling head.

3. A propelling head as in claim 1, in which said annular chamber has a plurality of air inlet ports, the axes of which intersect the axis of the through passage at the same point with the same acute angle, said ports being located at the same distance from the axis of the through passage and at the same distance from said annular slot.

4. A propelling head as in claim 1, in which said guiding ribs are constructed to divert air from the zone of transition between the compressed air inlet port and the annular chamber to the annular slot from a direction of flow which is determined by the axial direction of the compressed air inlet port in said zone of transition to a direction of flow parallel to the axis of the through passage, the said guiding ribs being spaced from the outer wall of the through passage.

5. A propelling head as in claim 1 characterized in that at the front end of the through passage for the tow there is provided an elongated extension tube of sustantially constant inner cross-sectional area and extending from the housing in a length which is at least four times the diameter of the inner wall of the annular slot.

6. A propelling head as in claim 5 for introducing multifilament tow through a filling opening and in which the extension tube is constructed at its end remote from the through passage with a flange extending radially outwards and having a circumferential contour corresponding to that of the filling opening, the flange being constructed with through holes, and with a conical net, which at its maximum diameter is fixed to the circumference of the flange and at its minimum diameter is fixed to the extension tube between the flange and the free end of the extension tube.

* * * * *